US008776644B2

(12) United States Patent
Harper et al.

(10) Patent No.: US 8,776,644 B2
(45) Date of Patent: Jul. 15, 2014 dkf iode

(54) ELECTRONIC IDENTIFIER ATTACHMENT FOR INVENTORY ITEMS

(75) Inventors: Lawrence E. Harper, Marietta, GA (US); Jeffrey M. Thrift, Allen, TX (US); Randall C. Shabram, Dallas, TX (US); Christopher J. Pauly, Savannah, TX (US); Christopher J. Ruf, Sandy Springs, GA (US); Nicholas E. Achterberg, New Freedom, PA (US); Bruno Le Gal, Val de Marne (FR)

(73) Assignee: Stanley Black & Decker, Inc., New Britain, CT (US)

( * ) Notice: Subject to any disclaimer, the term of this patent is extended or adjusted under 35 U.S.C. 154(b) by 264 days.

(21) Appl. No.: 13/362,175

(22) Filed: Jan. 31, 2012

(65) Prior Publication Data

US 2013/0186243 A1 Jul. 25, 2013

Related U.S. Application Data

(60) Provisional application No. 61/589,647, filed on Jan. 23, 2012.

(51) Int. Cl.
*B25B 23/00* (2006.01)

(52) U.S. Cl.
USPC ..... 81/180.1

(58) Field of Classification Search
USPC ..... 81/180.1; 340/5.92, 572.1
See application file for complete search history.

(56) References Cited

U.S. PATENT DOCUMENTS

| | | | | |
|---|---|---|---|---|
| 353,756 | A | 12/1886 | Parkhurst | |
| 1,984,839 | A | 12/1934 | Murray | |
| 3,251,150 | A | 5/1966 | Sedgwick | |
| 4,588,339 | A | 5/1986 | Bilz | |
| 4,720,907 | A | 1/1988 | Rapp | |
| 5,029,485 | A | 7/1991 | Marr | |
| 5,101,695 | A | 4/1992 | Johnson | |
| D353,756 | S | 12/1994 | Graves | |
| 6,234,051 | B1 * | 5/2001 | Bareggi | 81/479 |
| D472,778 | S | 4/2003 | Halstead | |
| 6,682,156 | B2 | 1/2004 | Herrington | |
| 6,827,275 | B2 | 12/2004 | Allen | |
| 6,840,451 | B2 | 1/2005 | Allen | |
| 6,989,749 | B2 | 1/2006 | Mohr | |
| 7,047,843 | B1 * | 5/2006 | Huang | 81/63.1 |
| 7,240,845 | B2 | 7/2007 | Komine et al. | |
| 7,253,736 | B2 | 8/2007 | Tethrake et al. | |
| 7,256,699 | B2 | 8/2007 | Tethrake | |
| 7,278,341 | B1 * | 10/2007 | Novin et al. | 81/121.1 |
| 7,315,248 | B2 | 1/2008 | Egbert | |
| 7,333,016 | B2 | 2/2008 | Ancel | |

(Continued)

FOREIGN PATENT DOCUMENTS

| | | | |
|---|---|---|---|
| DE | 102008013588 | A1 | 9/2009 |
| EP | 2395457 | A1 | 12/2011 |

(Continued)

*Primary Examiner* — David B Thomas

(74) *Attorney, Agent, or Firm* — Thomas|Horstemeyer, LLP

(57) ABSTRACT

Disclosed are various embodiments and a corresponding method for an adapter configured to attach an electronic identification device to an inventory item having a universal attachment fitting. A first end of the adapter body is configured to permanently attach to the universal attachment fitting. A second end of the adapter body is configured to attach to a tool configured to attach to the universal attachment fitting. An electronic identification device is attached to the adapter body.

24 Claims, 7 Drawing Sheets

(56) References Cited

U.S. PATENT DOCUMENTS

| | | | |
|---|---|---|---|
| 7,336,181 | B2 | 2/2008 | Nowak et al. |
| 7,339,477 | B2 | 3/2008 | Puzio et al. |
| 7,391,326 | B2 | 6/2008 | Puzio et al. |
| 7,431,682 | B2 | 10/2008 | Zeiler et al. |
| 7,483,766 | B1 | 1/2009 | Frankel |
| 7,557,709 | B2 | 7/2009 | Flores et al. |
| 7,586,417 | B2 | 9/2009 | Chisholm |
| 7,705,482 | B2 | 4/2010 | Leininger |
| 7,705,733 | B2 | 4/2010 | Tethrake et al. |
| 7,740,425 | B2 | 6/2010 | Zeiler et al. |
| 7,755,482 | B2 | 7/2010 | Hubbard |
| 7,819,318 | B2 | 10/2010 | White et al. |
| 7,932,824 | B2 | 4/2011 | Flores et al. |
| 8,020,768 | B2 | 9/2011 | Ramos-Elizondo et al. |
| 8,035,518 | B2 | 10/2011 | Kolton et al. |
| 8,040,221 | B2 | 10/2011 | Murray et al. |
| 8,047,746 | B2 | 11/2011 | Olsson et al. |
| 8,159,345 | B2 | 4/2012 | Stevens |
| 8,193,938 | B2 | 6/2012 | Halberthal et al. |
| 8,212,226 | B2 | 7/2012 | Chisholm |
| 8,242,914 | B2 | 8/2012 | Matityaho et al. |
| 2003/0102970 | A1 | 6/2003 | Creel |
| 2003/0105599 | A1 | 6/2003 | Fisher et al. |
| 2004/0200980 | A1 | 10/2004 | Blackwell |
| 2006/0085297 | A1 | 4/2006 | Minerley |
| 2007/0124220 | A1 | 5/2007 | Griggs |
| 2007/0152046 | A1 | 7/2007 | Hsieh |
| 2007/0244470 | A1 | 10/2007 | Barker, Jr. et al. |
| 2007/0262867 | A1 | 11/2007 | Westrick et al. |
| 2007/0278786 | A1 | 12/2007 | Mezhinsky et al. |
| 2008/0115636 | A1 | 5/2008 | DeRose et al. |
| 2008/0177267 | A1 | 7/2008 | Sands |
| 2008/0178713 | A1* | 7/2008 | Long et al. ..... 81/467 |
| 2008/0252446 | A1 | 10/2008 | Dammertz |
| 2008/0262526 | A1 | 10/2008 | Neubardt et al. |
| 2008/0303674 | A1 | 12/2008 | Hara et al. |
| 2009/0175694 | A1 | 7/2009 | Craig et al. |
| 2009/0283595 | A1 | 11/2009 | White et al. |
| 2010/0096455 | A1 | 4/2010 | Binmore |
| 2010/0252626 | A1 | 10/2010 | Elizondo |
| 2010/0277277 | A1 | 11/2010 | Green |
| 2010/0289626 | A1 | 11/2010 | Oberle |
| 2011/0025469 | A1 | 2/2011 | Erdmann et al. |
| 2011/0057854 | A1 | 3/2011 | Elbinger et al. |
| 2011/0109093 | A1 | 5/2011 | Leininger |
| 2012/0007748 | A1 | 1/2012 | Forgues et al. |
| 2012/0143049 | A1* | 6/2012 | Neubauer et al. ..... 600/424 |
| 2012/0240392 | A1* | 9/2012 | Rudduck ..... 29/705 |
| 2013/0047799 | A1* | 2/2013 | Gareis ..... 81/467 |

FOREIGN PATENT DOCUMENTS

| | | | |
|---|---|---|---|
| GB | 2451957 | A | 2/2009 |
| GB | 2465807 | A | 6/2010 |
| JP | 2007183840 | | 7/2007 |
| WO | 2006100283 | A1 | 3/2006 |

* cited by examiner

ELECTRONIC IDENTIFIER ATTACHMENT FOR INVENTORY ITEMS

CROSS REFERENCE TO RELATED APPLICATIONS

This application claims priority to U.S. Provisional Patent Application No. 61/589,647 filed on Jan. 23, 2012 entitled "Electronic Identifier Attachment for Inventory Items," which is incorporated herein by reference in its entirety.

BACKGROUND

A Radio Frequency Identification (RFID) tag is a type of electronic identification device that may be used to identify and track various objects. In practice, an RFID tag is attached to an object, and an RFID reader senses the presence and identifying information associated with the RFID tag. The RFID reader may be located at an entrance or exit of an environment, thus facilitating the tracking and identifying of objects having RFID tags that enter or exit the environment.

RFID tags may be added to existing objects so that they may be tracked. To this end, an RFID tag may be mounted to the exterior of an object using adhesives or shrink wrap. However, by being mounted to the exterior of an object, the RFID tag may impede the intended functionality of the object. For example, if an RFID tag were mounted to the exterior of a socket tool, the socket tool may not be able to fit into tight spaces due to the increased size of the tool created by the added RFID tag. Additionally, retrofitting a tool with an RFID tag may be visually unattractive.

In order to overcome these obstacles, some objects may be manufactured to incorporate an RFID tag. However, it may be expensive to replace existing objects with new RFID-enabled objects. For example, a mechanic shop may have a huge inventory of socket tools. Replacing the huge inventory of existing tools with new RFID-enabled tools may be expensive and impractical.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

In accordance with the present disclosure, existing inventory items, such as but not limited to, socket tools, air tool fittings, driver bits (e.g., Phillips bits, flathead bits, hex-head bits, TORX® bits, APEX® bits, etc.) allen wrenches, hoses, welding equipment, medical equipment, or any inventory item having a universal attachment fitting, may be retrofitted to become RFID-enabled while maintaining the intended functionality of the inventory items. In general, the present disclosure is directed towards permanently attaching an adapter equipped with an electronic identification device to an inventory item. As used herein, the term "permanently attached" refers to an attachment that is not intended to be removed, unless defeated by component failure, unauthorized removal, or other types of unintended activity. As a non-limiting example, one end of an adapter equipped with an RFID tag is configured to permanently attach to one or more inventory items, such as a socket, a conventional socket adapter, a crowfoot wrench, etc., while the other end of the adapter is configured to removably attach to a socket driver. As such, the adapter, RFID tag, and socket may be a substantially unitary piece. By being configured to permanently attach to a universal attachment fitting, one adapter style may be produced that is capable of permanently attaching to multiple sizes and styles of sockets.

With the RFID enabled adapter permanently attached to a socket or other type of inventory item, an RFID reader may identify or track the inventory item by sensing signals emitted from the RFID tag. For example, an RFID tag reader may be installed at an entrance or exit of an environment, and the activity associated with the inventory item may be monitored. This monitoring may be especially useful, for example, in operating rooms where it is extremely important to track medical tools, in mechanical environments where a lost tool may cause damage to equipment, in an environment where inventory item theft may be a concern, or in other environments. In the following discussion, a general description of the apparatus and its components are provided, followed by a discussion of the operation of the same.

Figure 1A:
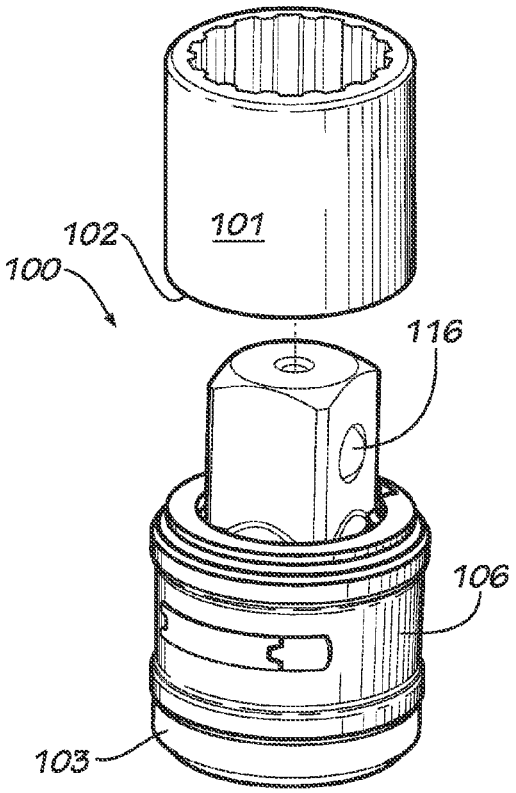
FIGS. 1A-1C are drawings of an adapter according to various embodiments of the present disclosure.
Figure 1C:
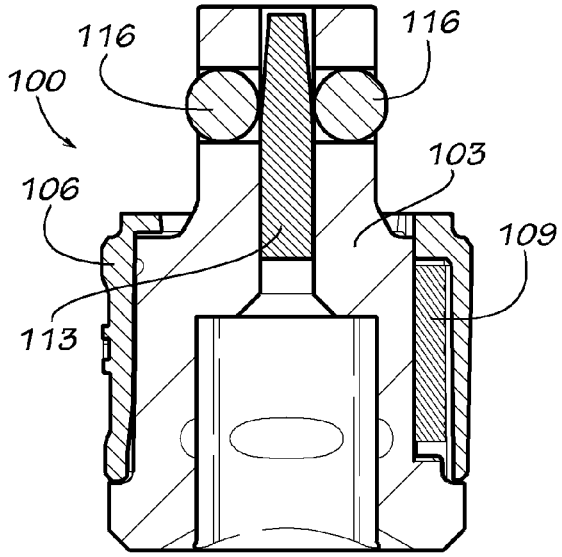
Figure 1B:
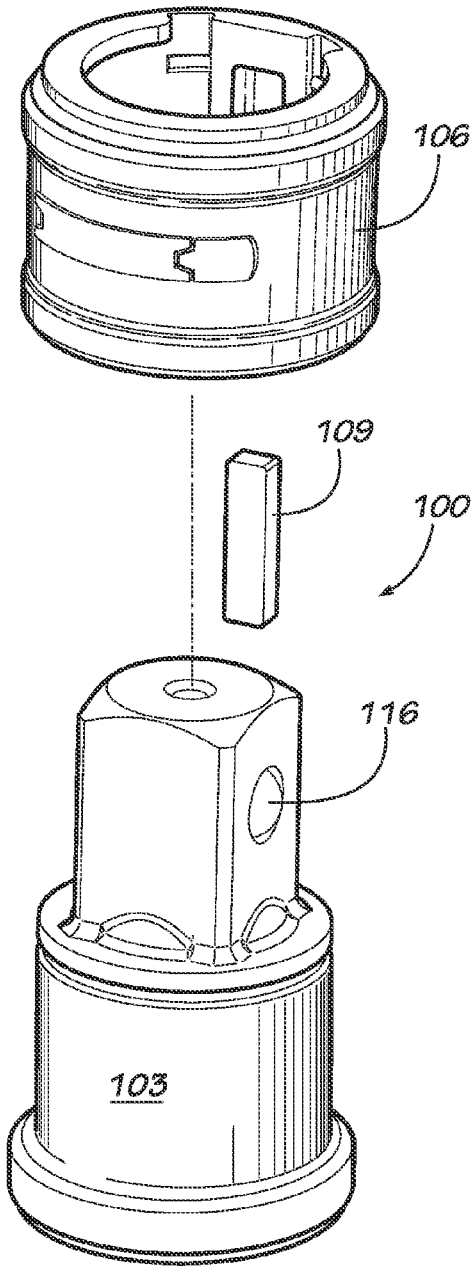

With reference to FIGS. 1A-1C, shown is an adapter 100 according to one embodiment, among others, of the present disclosure. The adapter 100 shown in FIGS. 1A-1C is configured to become a substantially unitary piece with the inventory item 101. The inventory item 101 has a female fitting 102 facilitating attachment between the adapter 100 and inventory item 101. As may be appreciated, the female fitting 102 is common to other related inventory items 101 so that a common tool (e.g., a socket driver) may attach to several inventory items 101. In this sense, the female fitting 102 may be considered one example, among others, of a universal attachment fitting. Additionally, a universal attachment fitting in various embodiments may be, for example but not limited to, male fittings, threaded joints, quick-release couplings, or any other universal attachment fitting being a deliberate mechanical point of connection for the inventory item 101.

In the embodiment shown, the inventory item 101 is embodied in the form of a socket. It is understood that in alternative embodiments, the inventory items 101 may be, for example but not limited to, socket tools, air tool fittings, driver bits (e.g., Phillips bits, flathead bits, hex-head bits, TORX® bits, APEX® bits, etc.) allen wrenches, hoses, welding equipment, medical equipment, or any inventory item having a universal attachment fitting. The adapter 100 may also be preconfigured to be attached to another inventory item 101 or tool such as, for example, a preexisting fitting of a powered or manual driver tool (not shown).

The adapter 100 includes an adapter body 103, an adapter cover 106, an RFID tag 109, an insert 113, one or more retaining elements 116, and possibly other components not discussed in detail herein. The adapter cover 106 surrounds a portion of the adapter body 103 and secures the RFID tag 109 to the adapter body 103. The adapter cover 106 may be transparent to radio frequency energy to facilitate the RFID tag 109 transmitting and/or receiving signals.

The retaining elements 116 are disposed at least partially within the adapter body 103 and facilitate retaining the adapter 100 to an inventory item 101, as will be described later. The insert 113 is also disposed at least partially within the adapter body 103 and extends along a longitudinal axis of the adapter body 103. As will be described later, the insert 113 may extend the retaining elements 116 to facilitate permanent attachment of the adapter 100 to the inventory item 101.

Figure 2A:
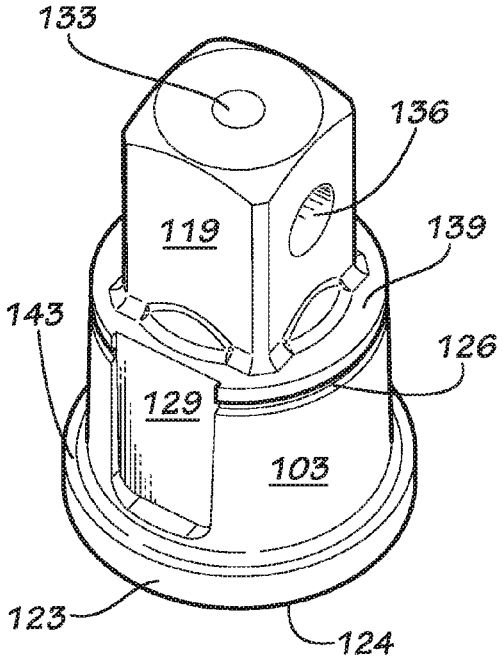
FIGS. 2A-2C are drawings of an adapter body of the adapter of FIGS. 1A-1C according to various embodiments of the present disclosure.
Figure 2B:
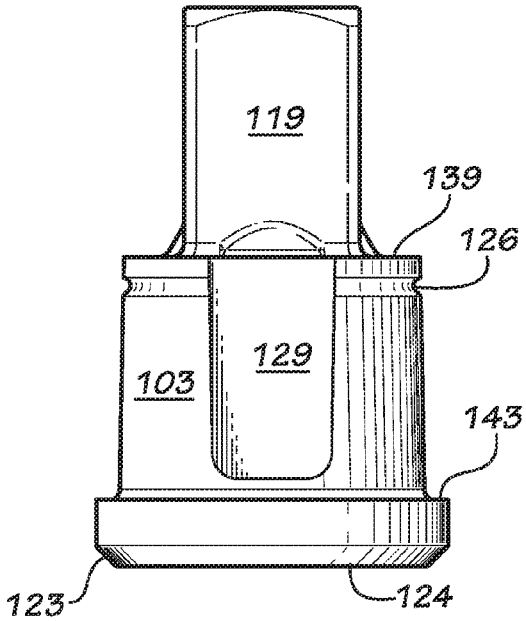
Figure 2C:
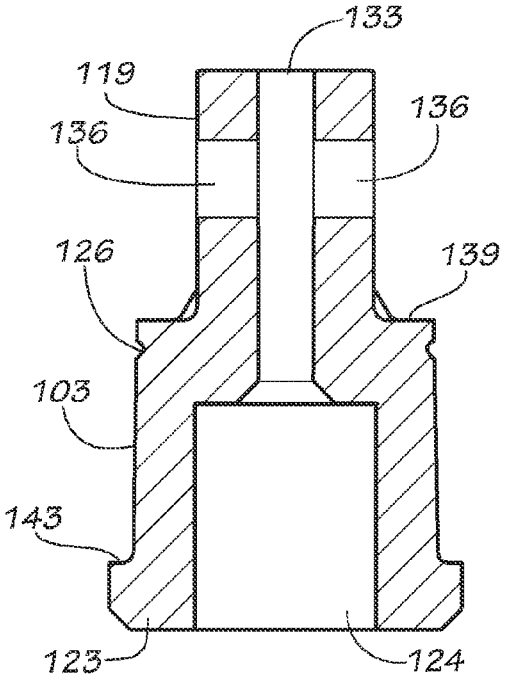

Turning to FIGS. 2A-2C, shown is the adapter body 103 according to various embodiments of the present disclosure. The adapter body 103 in the present embodiment includes a male end 119 configured to be received in a female fitting 102 (FIG. 1A) of the inventory item 101 (FIG. 1A). Opposite of the male end 119 is a female end 123 and a female recess 124 configured to receive, for example, a socket driver.

As will be described below, in the embodiment shown, the male end 119 is configured to permanently attach to the inventory item 101, while the female end 123 is preconfigured to attach to, for example, a male end of a socket driver tool or other type of powered or manual tool (not shown). It is understood that although the embodiment shown has a male end 119 and a female end 123, both ends may be male or both ends may be female in alternative embodiments.

Although shown in FIGS. 2A-2C as being formed of a single unit, the adapter body 103 may instead comprise multiple components that are assembled to form the adapter body 103. For example, the male end 119 may be detached from the remainder of the adapter body 103. In such a case, during assembly, the male end 119 may be attached to the remainder of the adapter body 103 by a weld, threads, or other attachment methods.

The adapter body 103 may also include a groove 126, a recess 129, an orifice 133, one or more bores 136, an edge 139, a rim 143, and possibly other features not discussed in detail herein. The groove 126 extends at least partially circumferentially around the adapter body 103. The recess 129 is a depressed region of the adapter body 103 and may take a shape that is slightly larger than the RFID tag 109 or a holder of the RFID tag 109.

The orifice 133 extends longitudinally from the male end 119 to the female recess 124. In alternative embodiments, the orifice 133 may not extend completely to either one of the ends. The one or more bores 136 extend from an outer surface of the male end 119 to the orifice 133 and are configured to receive the retaining elements 116 (FIG. 1A-1C).

The edge 139 may be a surface configured to be adjacent to the inventory item 101. The rim 143 may be disposed along the adapter body 103 towards the female end 123. Both the edge 139 and rim 143 may facilitate attaching and retaining the adapter cover 106 to the adapter body 103 as will be described later.

Figure 3A:
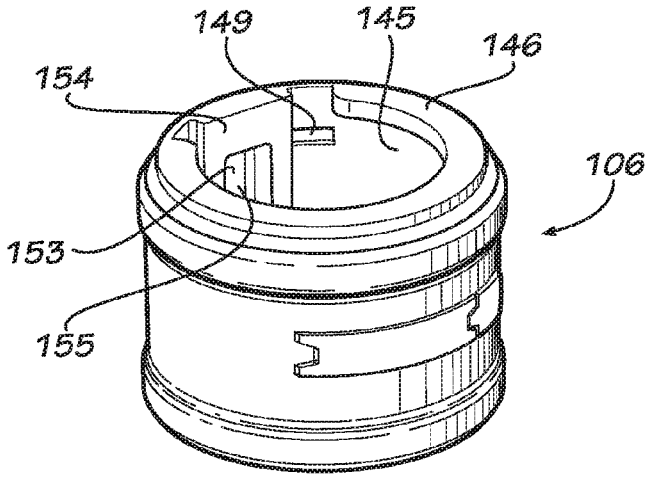
FIGS. 3A-3C are drawings of an adapter cover of the adapter of FIGS. 1A-1C according to various embodiments of the present disclosure.
Figure 3B:
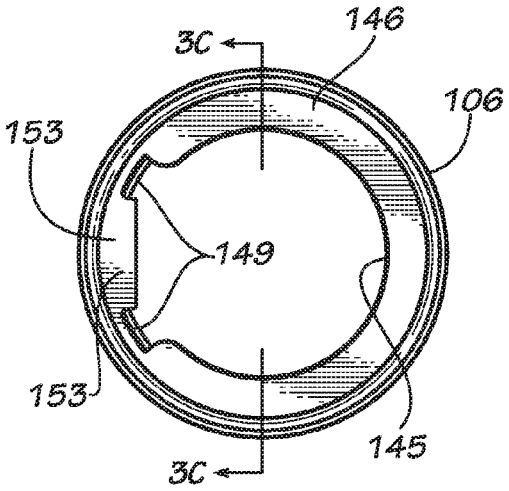
Figure 3C:
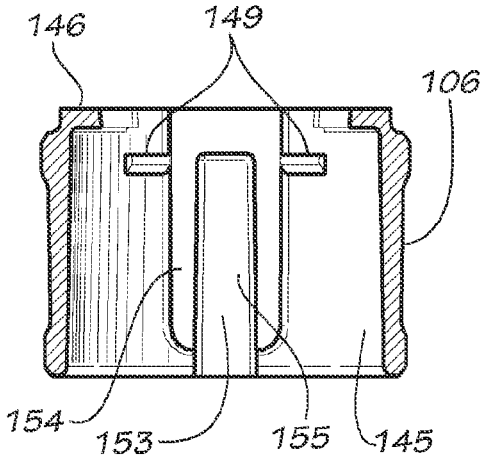

With reference now to FIGS. 3A-3C, shown is one example of an adapter cover 106 according to various embodiments of the present disclosure. The adapter cover 106 shown in FIGS. 3A-3C is embodied in the form of a collar that surrounds a portion of the adapter body 103. The adapter cover 106 may act as a covering to protect and/or permanently secure the RFID tag 109 to the adapter body 103. In alternative embodiments, the adapter cover 106 may partially cover a portion of the adapter body 103, instead of completely surrounding the circumference of the adapter body 103.

The adapter cover 106 includes an interior surface 145 extending through the adapter cover 106 for at least a portion of the adapter body 103 to pass through the adapter cover 106. In various embodiments, the adapter cover 106 may be constructed of nylon or other plastic-type materials to facilitate transmission of signals to and from the RFID tag 109. However, it is understood that the adapter cover 106 may be constructed of other materials that are transparent to radio frequency energy.

The adapter cover 106 may also include a lip 146, one or more detents 149, a receptacle 153, and possibly other features not discussed in detail herein. The lip 146 extends from an interior surface at an end of the adapter cover 106. Although shown in FIGS. 3A-3C as extending from most of the circumference of the adapter cover 106, the lip 146 may instead extend from only a portion of an end of the adapter cover 106. Additionally, in alternative embodiments, the adapter cover 106 may include multiple lips 146 located at one or both ends of the adapter cover 106.

The one or more detents 149 are disposed on the interior surface 145 of the adapter cover 106. Although shown in FIGS. 3A-3C as being located adjacent to the receptacle 153, the one or more detents 149 may be located opposite of the receptacle 153, causing the RFID receptacle to be snug against the adapter body 103. Further, it is understood that the one or more detents 149 or other types of restrictions may be disposed anywhere along the interior surface 145 of the adapter cover 106. As will be described below, the detents 149 may aid in aligning the adapter cover 106 with the adapter body 103 during assembly of the adapter 100. Further, the detents 149 may facilitate attachment of the adapter cover 106 to the adapter body 103 during assembly of the adapter 100.

The receptacle 153 includes a frame 154 extending from the interior surface 145 of the adapter cover 106 and a pocket 155 configured to receive the RFID tag 109. The receptacle 153 may aid in aligning the adapter cover 106 with the adapter body 103 during assembly of the adapter 100. Further, the receptacle 153 may provide cushioning or protection for the RFID tag 109.

Referring back to FIGS. 1A-1C, the RFID tag 109 is a type of electronic identification device that emits an identifying signal that is capable of being received by an appropriate RFID reader. The identifying signal may include data that uniquely corresponds to the RFID tag 109, thereby facilitating the identification of an object to which the RFID tag 109 is attached. The RFID tag 109 may be active, semi-active, or passive and may or may not include storage memory. In alternative embodiments, the functionality of the RFID tag 109 may be replaced with other types of electronic identification devices capable of emitting an identifying signal and being receivable by an appropriate receiving device.

The retaining element 116 facilitates permanently attaching the adapter 100 to the female fitting 102 of the inventory item 101. In the embodiment shown, the retaining element 116 is embodied in the form of a ball. In alternative embodiments, retaining members such as prongs, barbs, tabs, ears, snaps, cylinders, fins, or any other types of retaining elements 116 may be used. Additionally, it is noted that one or more retaining elements 116 may be used in various configurations.

In the embodiment shown in FIGS. 1A-1C, the retaining elements 116 are configured to be retained, at least partially, in the bores 136 of the adapter body 103. Additionally, the retaining elements 116 are configured to be retained in a receiving portion 156 (FIG. 4A) of the inventory item 101. As will be discussed, the retaining elements 116 are configured to move from a retracted position, with the retaining elements 116 at least partially within the adapter body 103, to a locking position, with the retaining elements 116 disposed at least partially within the inventory item 101. Although the present embodiment discloses a bore 136, it is understood that any other type of retaining member recess may be used to receive the retaining elements 116 or other types of retaining members.

The insert 113 may be configured to extend and stake the retaining elements 116 from the retracted position to the locking position. As shown in FIGS. 1A-1C, the insert 113 may be cylindrical in form with a wedged portion at one end. In an alternative embodiment, the insert 113 may be embodied in the form of a coiled spring pin. In other various embodiments, the other types of inserts 113, such as a wedge, a cylindrical pin, or other types of inserts 113, may be used.

Figure 4A:
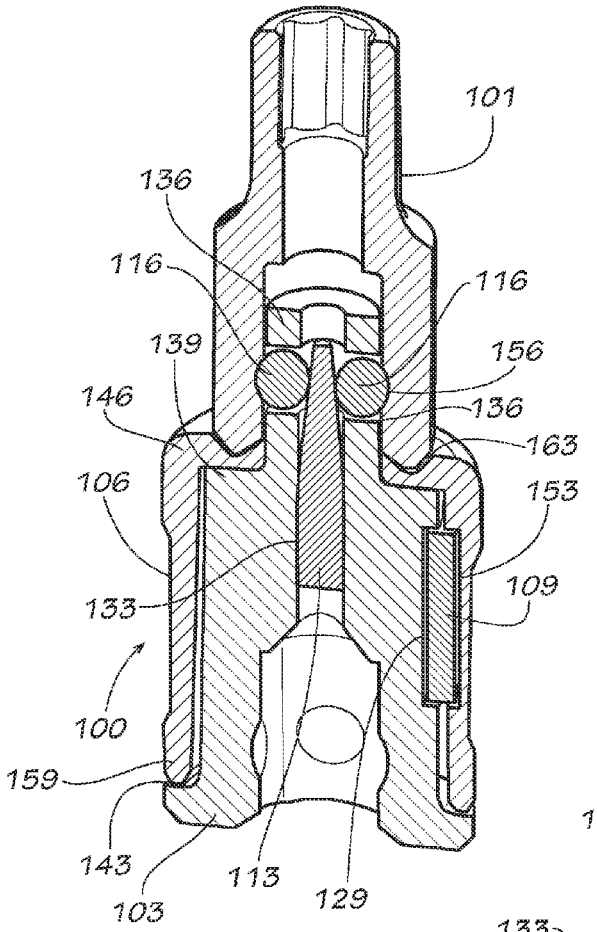
FIGS. 4A-4B, 5A-5B, and 6A-6B are drawings of the adapter of FIGS. 1A-1C attached to an inventory item according to various embodiments of the present disclosure.
Figure 4B:
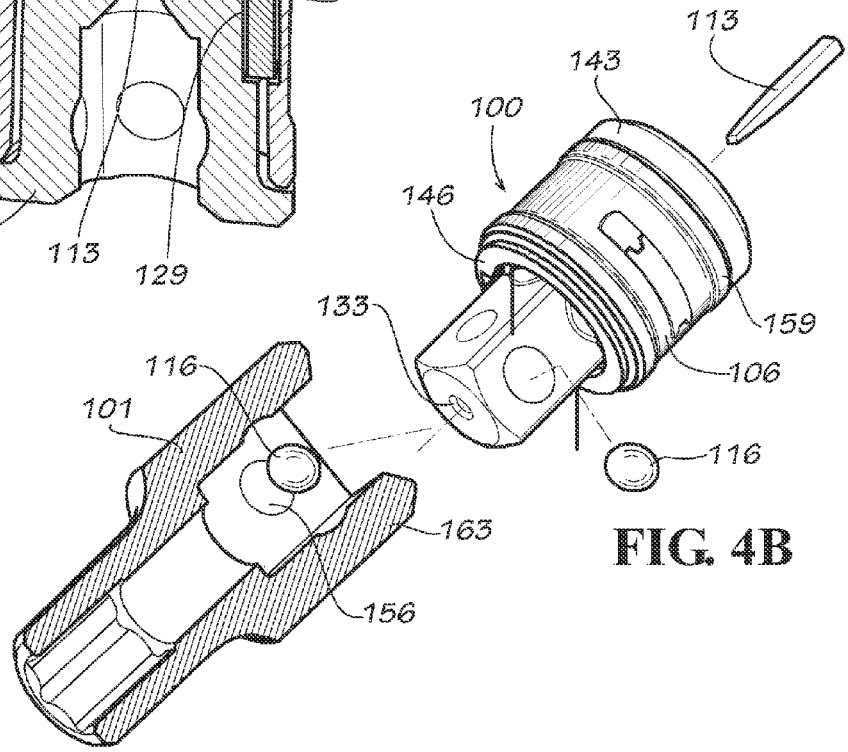

Next, a description of the operation of the various components of one example, among others, of the adapter 100 is provided. Turning to FIGS. 4A-4B, shown is the adapter 100 and its interaction with an inventory item 101 according to various embodiments. As best shown in FIG. 4A, the adapter 100 is permanently attached to the inventory item 101.

In order to assemble the adapter 100, the RFID tag 109 may be placed in the receptacle 153 of the adapter cover 106, and the adapter cover 106 may be slid over the adapter body 103. The detents 149 (FIGS. 3A-3C) and lip 146 of the adapter cover 106 may facilitate proper alignment of the adapter cover 106 with respect to the adapter body 103. To this end, the detents 149 of the adapter cover 106 may align with and/or snap into the groove 126 (FIGS. 2A-2C) of the adapter body 103, thereby indicating proper alignment and facilitating attachment of the adapter cover 106 to the adapter body 103. Similarly, the lip 146 of the adapter cover 106 may abut the edge 139 of the adapter body 103, and an end 159 of the adapter cover 106 may abut the rim 143 of the adapter body 103. Thus, the adapter cover 106 may be properly aligned in a longitudinal direction during assembly of the adapter 100.

In a similar fashion, the recess 129 of the adapter body 103 and receptacle 153 of the adapter cover 106 facilitate proper rotational alignment of the adapter body 103 with respect to the adapter cover 106. Because the recess 129 is configured to accommodate the shape of the receptacle 153, proper rotational alignment during assembly is apparent during assembly. Additionally, the adapter cover 106 may be prevented from rotating after assembly.

The retaining elements 116 may be placed in the bores 136 of the adapter body 103, and the inventory item 101 may be placed on the appropriate end of the adapter body 103. As best shown in FIG. 4A, the lip 146 of the adapter cover 106 may compress between the edge 139 of the adapter body 103 and an end 163 of the inventory item 101. When the inventory item 101 is permanently attached to the adapter 100, such compression between the edge 139 of the adapter body 103 and the end 163 of the inventory item 101 facilitates the adapter cover 106 being permanently attached to the adapter body 103.

The insert 113 may be inserted into the orifice 133 of the adapter body 103. The insert 113 may be driven or forced into position using, for example, a hammer or other method. By driving the insert 113 into the orifice 133, the retaining elements 116 are extended from a retracted position to a locking position by engaging the retaining element 116 receiving portions 156. Friction between the insert 113 and the orifice 133 retains the insert 113, and thus the retaining elements 116, in the locking position. With the retaining elements 116 engaging the receiving portions 156, the adapter 100 may be permanently attached to the inventory item 101.

Figure 5A:
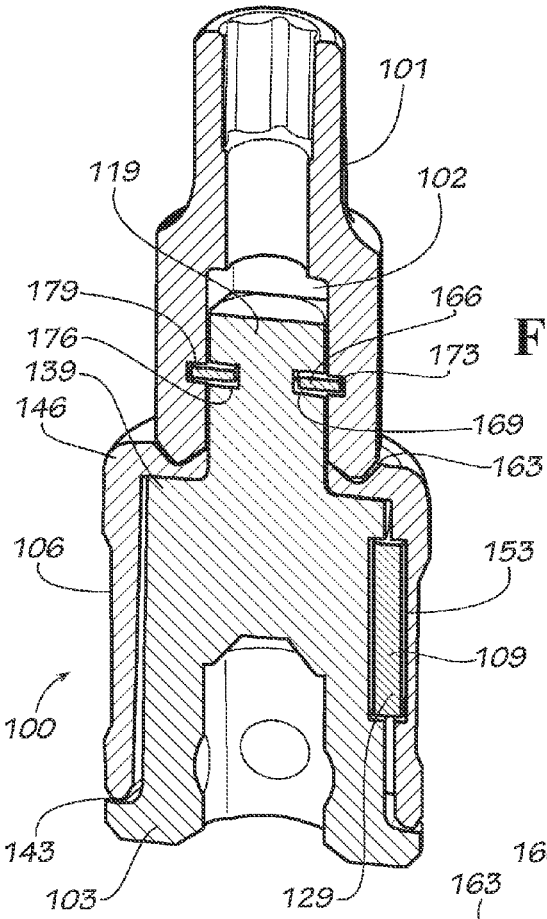
Figure 5B:
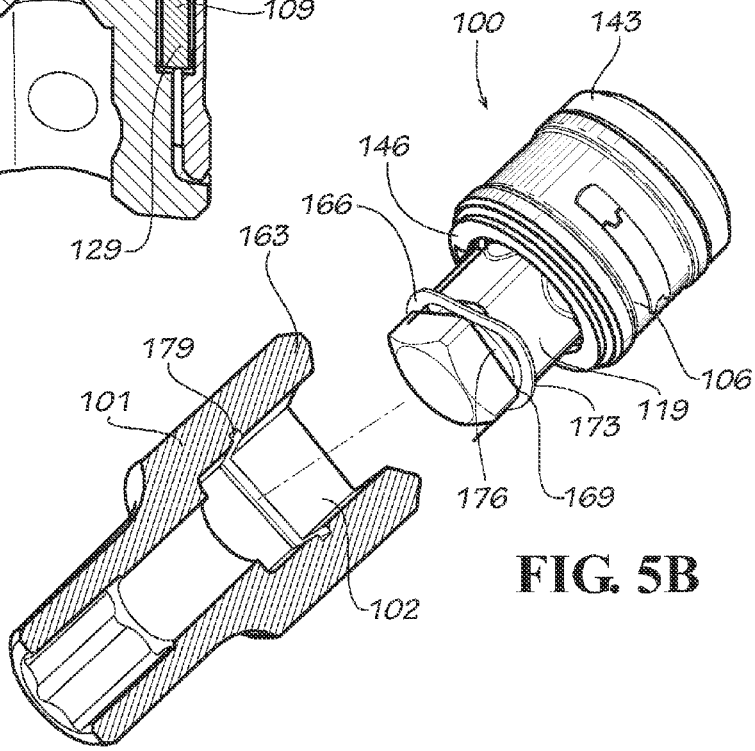

Turning now to FIGS. 5A-5B, shown is another embodiment, among others, of the adapter 100 configured to permanently attach to the inventory item 101. Although FIGS. 5A-5B show the inventory item 101 embodied as a socket, it is understood that the inventory item 101 may be other types of inventory items 101 as well.

The adapter cover 106, RFID tag 109, adapter body 103, and inventory item 101 are similar to as is described above. However, in the embodiment shown, a retaining ring 166 facilitates permanent attachment of the adapter 100 to the inventory item 101. The retaining ring 166 may comprise a rigid material, for example, and includes an inner edge 169 and an outer edge 173.

The male end 119 of the adapter body 103 now includes a groove 176 configured to accommodate the inner edge 169 of the retaining ring 166. The female fitting 102 of the inventory item 101 also includes a groove 179 configured to receive the outer edge 173 of the retaining ring 166.

In order to permanently attach the adapter 100 to the inventory item 101, the RFID tag 109 and adapter cover 106 may be attached to the adapter body 103 as previously described. Additionally, the retaining ring 166 may be slid over the male end 119 of the adapter body 103, with the inner edge 169 of the retaining ring 166 fit into the groove 176 of the male end 119. Thereafter, the male end 119 of the adapter body 103 and the retaining ring 166 may be inserted into the female fitting 102 of the inventory item 101. The outer edge 173 of the retaining ring 166 may insert into the groove 179 in the female fitting 102 of the inventory item 101. The retaining ring 166, in conjunction with the groove 179 in the inventory item 101 and the groove 176 in the male end 119 of the adapter body 103, may thereby prevent the inventory item 101 from being removed from the adapter 100. Thus, the adapter 100 may be permanently attached to the inventory item 101.

Figure 6A:
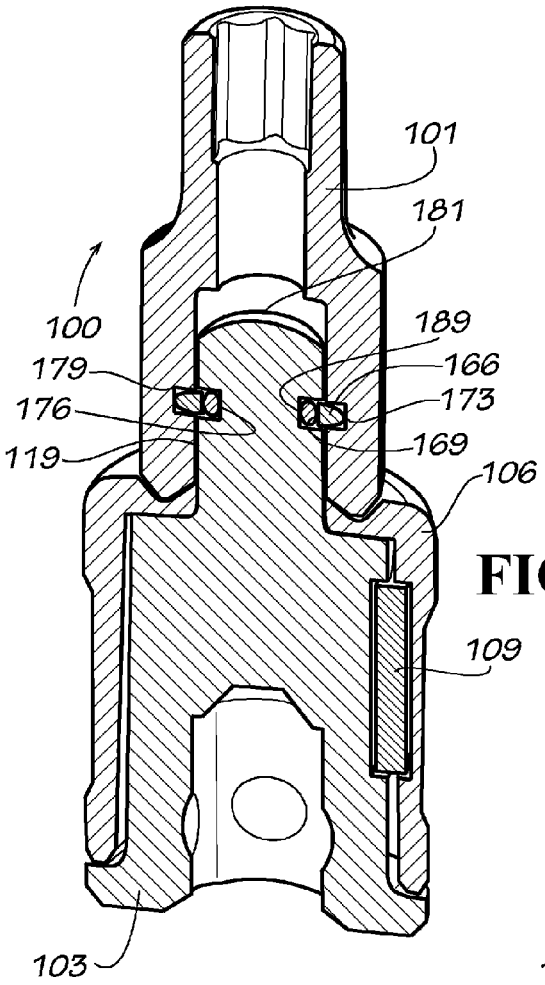
Figure 6B:
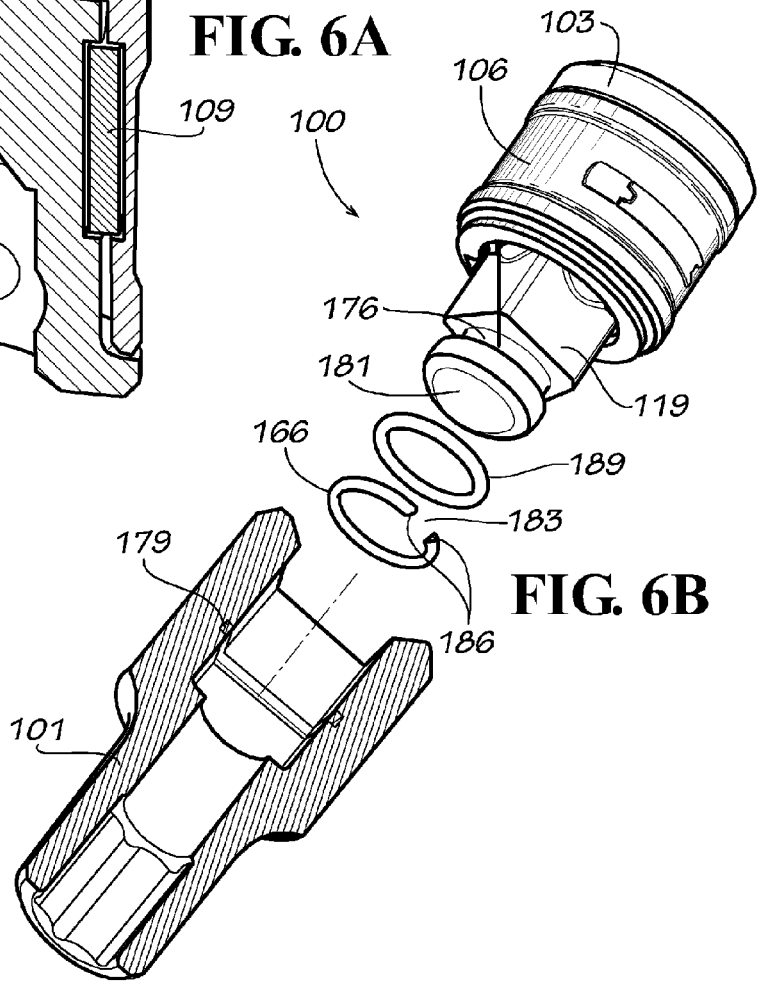

Turning now to FIGS. 6A-6B, shown is another embodiment, among others, of the adapter 100 configured to permanently attach to the inventory item 101. Although FIGS. 6A-6B show the inventory item 101 embodied as a socket, it is understood that the inventory item 101 may be other types of inventory items 101 as well.

The adapter cover 106, RFID tag 109, adapter body 103, and inventory item 101 are similar to as described above. In the embodiment shown in FIGS. 6A-6B, the male end 119 now has a rounded nose 181. Additionally, the retaining ring 166 is now embodied in the form of a C-style ring. As such, the retaining ring 166 in this embodiment includes a gap 183 between two ends 186 of the retaining ring 166. Furthermore, the inner edge 169 of the retaining ring 166 may be flat or slightly curved, and the outer edge 173 of the retaining ring 166 may be rounded. As such, a cross section of the retaining ring 166 may take the shape of a "D." It is understood, however, that a cross section of the retaining ring 166 may take other shapes in alternative embodiments.

Additionally, the adapter 100 includes an O-ring 189. The O-ring 189 may comprise a flexible material (e.g., rubber) that is capable of stretching, compressing, etc. The groove 176 in the male end 119 may accommodate the O-ring 189 and a portion of the retaining ring 166. Likewise, the groove 179 in the inventory item 101 may accommodate a portion of the retaining ring 166 as will be described.

In order to permanently attach the adapter 100 to the inventory item 101, the RFID tag 109 and adapter cover 106 may be attached to the adapter body 103 as previously described. Additionally, the O-ring 189 may be slid (or rolled) over the rounded nose 181 of the male end 119 of the adapter body 103 and fit into the groove 176 in the male end 119.

Thereafter, the retaining ring 166 may be placed over the O-ring 189 in the groove 176 of the male end 119. Then, the male end 119 of the adapter body 103 may be inserted into the female fitting 102 of the inventory item 101. By the male end 119 being inserted into the female fitting 102, the inventory item 101 may compress the retaining ring 166, thereby reducing the size of the gap 183. In turn, the retaining ring 166 may compress the O-ring 189.

Once the outer edge 173 of the retaining ring 166 is aligned with the groove 179 in the inventory item 101, the retaining ring 166 may expand due to internal forces of the retaining ring 166 and/or force exerted from the O-ring 189. In turn, the outer edge 173 of the retaining ring 166 is forced into the groove 179 of the inventory item 101. Because of internal forces of the retaining ring 166 and/or force from the O-ring 189, a portion of the retaining ring 166 is disposed within both the groove 176 of the adapter body 103 and the groove 179 of the inventory item 101. Thus, the adapter 100 may be permanently attached to the inventory item 101. Further, it is noted that a chemical adhesive or other material may be placed on the male end 119 and/or female fitting 102 prior to attachment, in order to prevent vibration of the adapter 100 with respect to the inventory item 101.

The adapter 100 may be permanently attached to the inventory item 101 using various other techniques. In other embodiments, thermal expansion characteristics of various components may be exploited in order to permanently attach the inventory item 101 to the adapter 100. To this end, the materials forming the inventory item 101, the adapter body 103, the insert 113, the retaining elements 116 and/or other components may be selected so as to allow assembly with the components under heat or cold. While under the heat or cold, the various components may contract or expand, thereby facilitating the inventory item 101 being placed on (or in), the adapter 100. By removing the heat or cold, the components of the adapter 100 and/or inventory item 101 may expand or contract to their normal sizes, thereby creating a permanent attachment.

In various embodiments, a press pin or other type of fastener may extend through both the inventory item 101 and the adapter 100, thereby permanently attaching the inventory item 101 to the adapter 100. Also, alternative embodiments may be permanently attached using, for example, locking threads, adhesives, bonding agents, etc.

Further alternative embodiments include the use of deformable components. For example, instead of using a retaining element 116, a deformable element may be extended through the bores 136 by a force, causing the deformed element to permanently retain the inventory item 101. Other deformable components may be used as well.

Figure 7A:
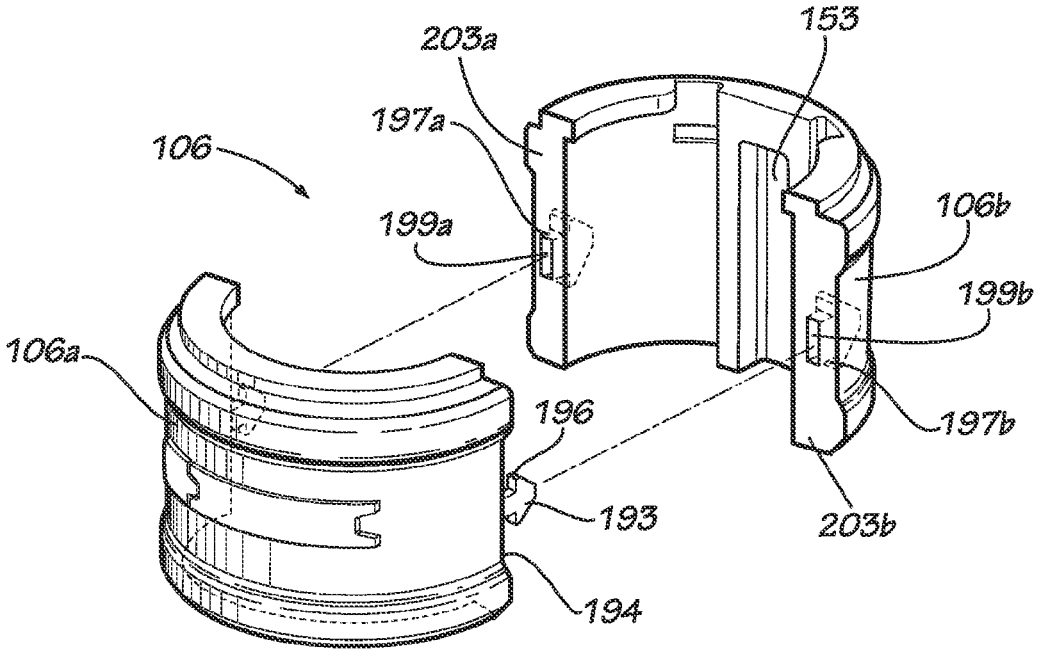
FIGS. 7A-7B are drawings of an alternative embodiment of the adapter cover of the adapter of FIGS. 1A-1C according to various embodiments of the present disclosure.
Figure 7B:
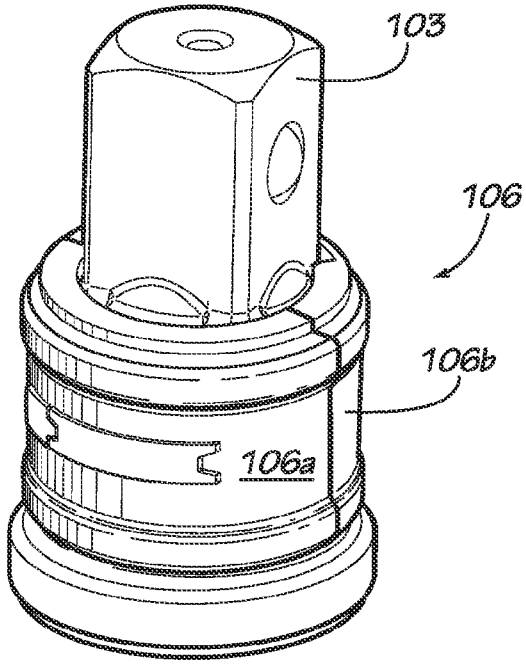

With reference now to FIGS. 7A-7B, shown is one example of an alternative embodiment, among others, of the adapter cover 106 and its interaction with the adapter body 103. It is understood that the adapter cover 106 of this embodiment may be used with other embodiments of the adapter body 103. The adapter cover 106 shown is similar to the adapter cover 106 described with reference to FIGS. 3A-3C. However, the adapter cover 106 in FIGS. 7A-7B further includes a first cover section 106*a* and a second cover section 106*b*. The first cover section 106*a* includes multiple tabs 193 extending from one or more ends 194 of the first cover section 106*a*. The tabs 193 may include prongs 196 to facilitate attaching the first cover section 106*a* to the second cover section 106*b*.

One or more tab receptacles 199*a*-199*b* may be disposed in the ends 203*a*-203*b* of the second cover section 106*b*. The tab receptacles 199*a*-199*b* may be configured to receive and permanently retain the tabs. To this end, the prongs 196 of the tabs 193 may engage corresponding shoulders 197*a*-197*b* within the tab receptacles 199*a*-199*b*. It is further noted that in various other embodiments, one end 203*a* of the second cover section 106*b* may be joined to the first cover section 106*a*, for example, by a hinge or other component.

When attaching the adapter cover 106 to the adapter body 103, the RFID tag 109 (FIG. 1B) may be placed in the receptacle 153, similar to as discussed above with reference to FIG. 3A. The first cover section 106*a* and second cover section 106*b* may then be joined over the adapter body 103, and the tabs 193 may be inserted into tab receptacles 199*a*-199*b*. Because the prongs 196 will abut the shoulders 197*a*-197*b* of the tab receptacles 199*a*-199*b*, the first cover section 106*a* and second cover section 106*b* may be permanently attached. Thereafter, the adapter body 103 may be attached to the inventory item 101, as discussed above.

It is emphasized that the above-described embodiments of the present disclosure are merely possible examples of implementations set forth for a clear understanding of the principles of the disclosure. Many variations and modifications may be made to the above-described embodiments without departing substantially from the spirit and principles of the disclosure. All such modifications and variations are intended to be included herein within the scope of this disclosure and protected by the following claims.

The invention claimed is:

1. An apparatus configured to attach to a socket to create a substantially unitary piece, the apparatus comprising:

an adapter body comprising:

a male end and a female end, the male end configured to insert into a female universal attachment fitting of the socket, the female end configured to removably attach to a socket driver;

a recess disposed between the male end and the female end; and a groove disposed around at least a portion of the adapter body;

a cover disposed around at least a portion of the adapter body, the cover comprising:

a lip configured to be retained between the adapter body and the socket;

a receptacle disposed on an interior surface of the cover, the receptacle adapted to fit at least partially within the recess of the adapter body; and a detent disposed on an interior surface of the cover, the detent adapted to fit at least partially within the groove of the adapter body; and a radio frequency identification tag disposed in the receptacle of the cover.

2. The apparatus of claim 1, further comprising an insert and a plurality of retaining balls;

wherein:

an orifice extends from the male end to the female end of the adapter body;

a bore extends through the male end of the adapter body;

the insert is configured to be disposed within the orifice; and the retaining balls are configured to be disposed at least partially within the bore.

3. The apparatus of claim 1, further comprising a retaining ring comprising an inner edge and an outer edge;

wherein:

the male end further comprises a retaining groove configured to receive the inner edge of the retaining ring; and the outer edge of the retaining ring is configured to be retained in a corresponding retaining groove disposed in the female universal attachment fitting of the socket.

4. The apparatus of claim 1, further comprising a C-style retaining ring and an O-ring, the C-style retaining ring comprising an inner edge and an outer edge;

wherein:

the male end of the adapter body further comprises a retaining groove configured to receive the O-ring and the inner edge of the C-style retaining ring;

the outer edge of the C-style retaining ring is configured to be retained in a corresponding retaining groove disposed in the female universal attachment fitting of the socket; and the C-style retaining ring is configured to compress the O-ring against the male end.

5. An apparatus, comprising:

an adapter body comprising a first end and a second end, the first end configured to attach to one of a plurality of inventory items to create a substantially unitary piece, each of the inventory items having a universal attachment fitting, the second end configured to attach to a tool that is configured to attach to the universal attachment fitting;

a cover configured to be positioned over at least a portion of the adapter body; and an electronic identification device configured to be permanently attached to the adapter body by being positioned between the cover and the adapter body.

6. The apparatus of claim 5, wherein the cover further comprises a lip configured to be retained between the adapter body and the one of the inventory items.

7. The apparatus of claim 5, further comprising a retaining member configured to move at least partially into the one of the inventory items.

8. The apparatus of claim 7, further comprising an insert configured to be disposed within the adapter body and move the retaining member at least partially into the one of the inventory items.

9. The apparatus of claim 5, further comprising a retaining ring comprising an inner edge and an outer edge; and wherein the inner edge is configured to be disposed within the adapter body, and the outer edge is configured to be disposed within the one of the inventory items.

10. The apparatus of claim 9, further comprising an O-ring configured to be disposed between the inner edge of the retaining ring and the adapter body.

11. The apparatus of claim 10, wherein the retaining ring is embodied in form of a C-style ring.

12. The apparatus of claim 5, wherein the inventory items are embodied in the form of a plurality of sockets.

13. The apparatus of claim 5, wherein the inventory items are embodied in the form of a plurality of air tool fittings.

14. The apparatus of claim 5, wherein the cover further comprises a first cover section that is configured to be joined to a second cover section.

15. The apparatus of claim 14, wherein the first cover section is configured to be permanently joined to the second cover section.

16. A method, comprising the steps of:

positioning an electronic identification device on or proximate to an adapter body, the adapter body comprising a first end and a second end, the first end configured to attach to a plurality of inventory items, each of the inventory items having a universal attachment fitting, the second end configured to attach to a tool that is configured to attach to the universal attachment fitting;

positioning a cover over the electronic identification device so that the electronic identification device is disposed between the adapter body and the cover; and attaching the first end of the adapter body to the universal attachment fitting of one of the inventory items to create a substantially unitary piece.

17. The method of claim 16, further comprising the step of moving a retaining element at least partially into the one of the inventory items.

18. The method of claim 17, wherein the step of moving the retaining element at least partially into the one of the inventory items further comprises moving an insert into the adapter body.

19. The method of claim 16, wherein the step of attaching the first end of the adapter body to the universal attachment fitting of the one of the inventory items further comprises:

disposing an inner edge of a retaining ring in the first end of the adapter body; and disposing an outer edge of the retaining ring in the one of the inventory items.

20. The method of claim 19, further comprising the step of compressing an O-ring between the retaining ring and the adapter body.

21. An apparatus, comprising:

an adapter body comprising:

means for attaching the adapter body to a universal attachment fitting of an inventory item to create a substantially unitary piece; and means for attaching the adapter body to a tool that is configured to attach to the universal attachment fitting; and means for attaching an electronic identification device to the adapter body.

22. The apparatus of claim 21, further comprising:

a retaining member configured to move at least partially into the inventory item; and means for moving the retaining member at least partially into the inventory item.

23. The apparatus of claim 21, further comprising a retaining ring comprising an inner edge and an outer edge; and wherein the inner edge is configured to be disposed within the adapter body, and the outer edge is configured to be disposed within the one of the inventory items.

24. The apparatus of claim 21, wherein the inventory is at least one of a socket or an air tool fitting.

* * * * *